United States Patent [19]

Blomberg

[11] 4,147,039

[45] Apr. 3, 1979

[54] ASSEMBLY AND CONTROL SYSTEM FOR MANUFACTURING AND SEPARATING ICE CUBES

[75] Inventor: Peter E. Blomberg, Stockholm, Sweden

[73] Assignee: Aktiebolaget Electrolux, Stockholm, Sweden

[21] Appl. No.: 827,726

[22] Filed: Aug. 25, 1977

[30] Foreign Application Priority Data

Aug. 27, 1976 [SE] Sweden ..... 7609525

[51] Int. Cl.[2] ..... F25C 5/08; F25B 47/00; F25D 23/12; F25B 15/10

[52] U.S. Cl. ..... 62/349; 62/277; 62/337; 62/492; 62/495

[58] Field of Search ..... 62/142, 148, 238, 277, 62/349, 352, 337, 492, 495

[56] References Cited

U.S. PATENT DOCUMENTS 2,743,588 5/1956 Dreier ..... 62/349

*Primary Examiner*—Lloyd L. King
*Attorney, Agent, or Firm*—Alfred E. Miller

[57] ABSTRACT

An ice cube freezing arrangement in an absorption type refrigerator having conduit means conducting hot vapors from a vapor conduit leading from the boiler system to the ice dividing walls and tray for ice cubes. The vapor conduit is normally blocked but opened occasionally in order to release the ice cubes from the tray. Thus, ice cubes are manufactured with relatively small energy consumption. The control system for ice freezing is completely internal in the refrigerator, which controls the ice making, ice releasing, and the water supply to the ice making device.

17 Claims, 10 Drawing Figures

ASSEMBLY AND CONTROL SYSTEM FOR MANUFACTURING AND SEPARATING ICE CUBES

BACKGROUND OF THE INVENTION

It is known in absorption type refrigerating apparatus to make ice in one or several ice trays, which after freezing contain a relatively large frozen body comprising pieces of ice separated from one another by dividing walls which adhere to the body. When it is desired to remove an ice cube or cubes, the ice tray must be taken out from the refrigerator and the cubes separated from one another and from the dividing walls and the ice tray. It is well known that it is often rather difficult to free the ice cubes from the tray. There are ice trays of a design which make the ice less difficult to handle, but in those cases, as a rule, one receives a very small quantity of ice. Although several trays can be used for the making of ice cubes, usually the space in a refrigerator is occupied by other things so that there is room for only one ice tray. It is also known that ice cubes are not needed continuously, but some time may pass between the occasions when ice is needed and removed; when ice is needed only one ice tray is generally available. Often, however, it is desired to use more ice than the quantity that can be held in a single ice tray, and on those occasions it is desirable to have ice available in the form of ready, separated ice cubes. It is, of course, possible to make ice in several trays, but with an absorption refrigerating apparatus it is also desired not to load the apparatus by freezing too large a quantity of water on the same occasion, since this would to some extent affect cooling of other items in the refrigerator. Therefore, it would be of considerable advantage to have a more or less continuous freezing and removal of a small quantity of ice, which processes could be repeated. This method is known in connection with compressor operated refrigerators, but in absorption type refrigerating apparatus it has not yet been successfully accomplished although U.S. Pat. No. 2,743,588 is directed to a secondary system for heat transfer to an ice cube tray in an absorption refrigerating apparatus and to an electric control system for the ice making.

SUMMARY OF THE INVENTION

An object of the present invention is to provide a ready supply of ice cubes in a vessel located in an absorption refrigerating apparatus.

A further object of the present invention is to manufacture ice cubes in an absorption refrigerating apparatus with relatively small energy consumption.

Another object of the present invention is to provide a control device for ice freezing which can be used in refrigerators without connection to an exterior source of energy. The invention generally contemplates the combination of means for transferring energy from the ice making device to the absorption refrigerating apparatus for freezing ice, and by means for transferring energy from the refrigerating apparatus to the ice making device for releasing the ice cubes, and by means for controlling a control device of the ice making device and its water supply by energy from the refrigerating apparatus.

The invention will now be more fully described with reference to the accompanying drawings in which.

DESCRIPTION OF THE PREFERRED EMBODIMENTS OF THE INVENTION

Figure 1:
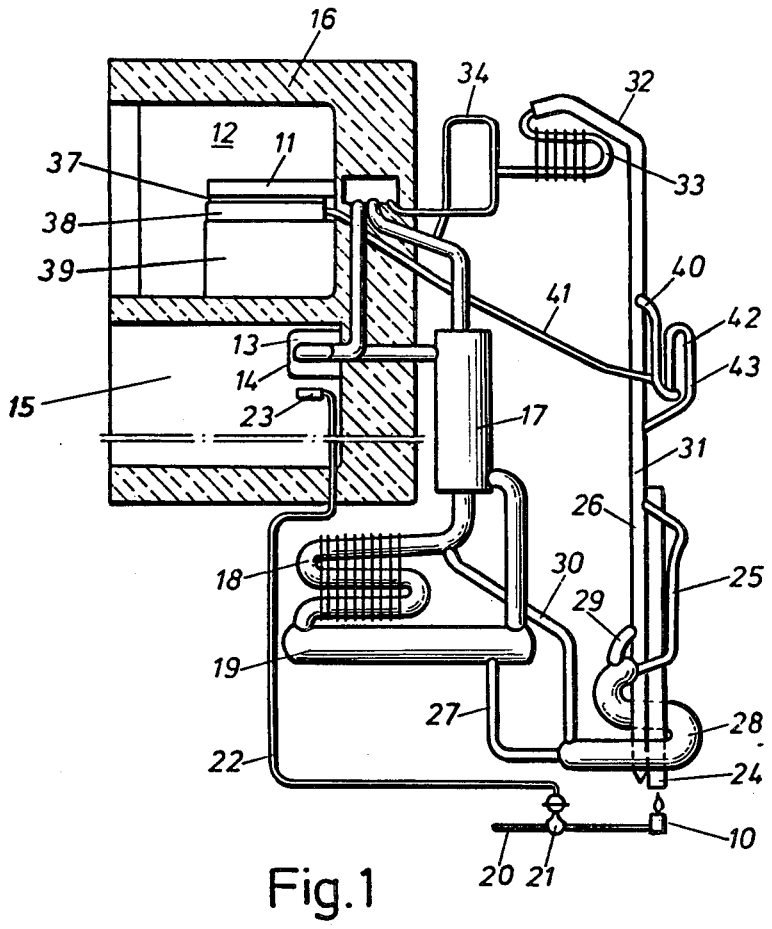
FIG. 1 is a diagrammatic view of a refrigerator of the absorption refrigerating type having means for making ice cubes and an ice cubes separating assembly.

The refrigerator, as shown in FIG. 1, is a cabinet with an absorption refrigerating apparatus operated by a gas burner 10. The apparatus contains a pressure equalizing gas, for example hydrogen. Water and ammonia may be used as the absorption medium and the refrigerant medium, respectively. The apparatus has one pipe coil forming a low temperature evaporator 11 in a freezing compartment or chamber 12, and another pipe coil having fins 13 which form a higher temperature evaporator 14 positioned in a chamber 15 and operating at a higher temperature in a cabinet 16, whose door is not shown. The evaporators 11 and 14 are both included in the gas circulation system of the apparatus, and the system, which is known, also includes conduits, a gas heat exchanger 17, an absorber 18, and an absorber vessel 19.

As seen in FIG. 1, the gas burner 10 is connected to a gas conduit 20 by a thermostat 21 connected by an impulse conduit 22 to a sensor 23 in the cooling chamber 15. The burner 10 discharges hot gases through a flue 24 which is heat-conductively connected to a liquid circulation pump 25 and a boiler 26.

A solution, rich in ammonia, is conducted from the absorber vessel 19 through a conduit 27 and a liquid heat exchanger 28 to the pump 25. This solution is lifted by the pump 25 while expelling ammonia vapor, and the weak solution is collected in the boiler 26 in which additional vapor is expelled. Thereafter, the weak solution is conducted by a conduit 29, the liquid heat exchanger 28 and a conduit 30 to the absorber 18, through which it flows while absorbing ammonia vapor from the rising, rich gas mixture.

Vapors expelled in the pump 25 and the boiler 26 are conducted by way of a vapor conduit 31 to a water separator 32 and a finned condenser 33. The condensate of ammonia formed in the condenser is conducted by means of a conduit 34 into the low temperature evaporator 11, in which part of the condensate evaporates while generating cold. The remaining condensate is conducted to the higher temperature evaporator 14, thereby cooling the chamber 15.

Figure 2:
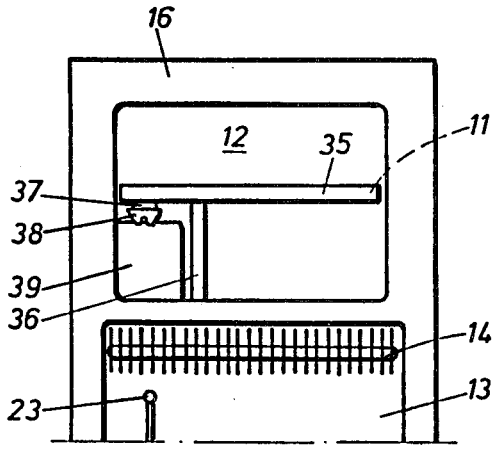
FIG. 2 is a front diagrammatic view of the upper part of the refrigerator.

It will be seen from FIG. 2, which shows a section of the refrigerator seen from the front, that in the freezing chamber 12 the evaporator coil 11 has a metal plate casing 35, which on one hand forms a surface-enlarging means for the evaporator 11, and on the other hand divides the chamber 12 into an upper and a lower part. The latter is divided by a vertical partition 36 into two spaces, in which the right space is intended for storing items to be frozen and the space on the left contains an ice dividing wall 37 disposed under the evaporator 11 and forming a cover for an ice tray 38. Under the tray 38 is a box 39 to collect ice cubes formed in the tray 38 and ejected therefrom.

Figure 3:
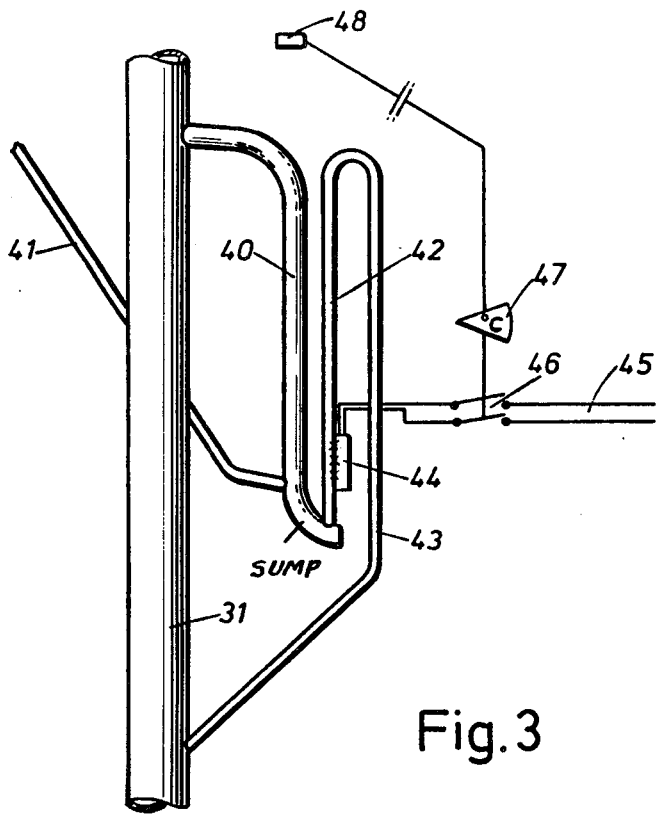
FIG. 3 is a diagrammatic view of a part of the vapor conduit of the refrigerating apparatus with means for supply of heat to the dividing wall of the ice cube tray.
Figure 4:
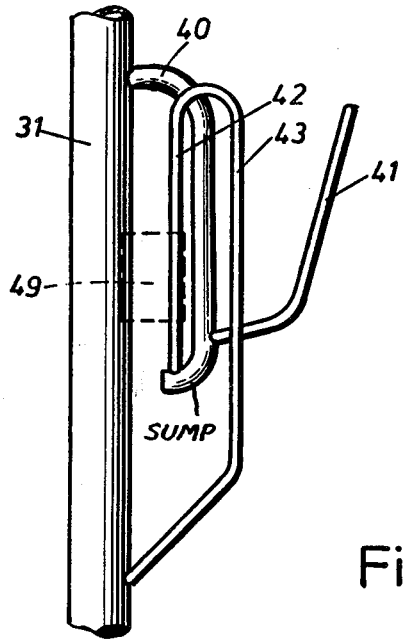
FIG. 4 is a diagrammatic view of a modification of the assembly shown in FIG. 3.

In accordance with the teachings of the present invention a connecting conduit 40,41 is heat-conductively connected to an ice dividing wall located in the freezer ice tray. The conduit can be heat-conductively connected also to the higher temperature evaporator 14, but is also possible to have a separate connecting conduit for defrosting this evaporator. As seen in FIG. 3 and 4, the conduit is in known manner constructed to form a sump connected to the vapor conduit 31 in which refrigerant vapor condenses and is collected whereby the condensate blocks the way for vapor through the connecting conduit 40, 41. A siphon is connected by its short leg 42 to the lower part of the sump in the conduit part 40 and by its long leg 43 to the vapor conduit 31 in order to provide occasional heat transfer between the vapor space of the boiler system and the dividing wall 37. When the liquid in the sump of the known defrosting device has risen sufficiently, the siphon 42,43 starts operation automatically and empties the liquid seal, which will remain open during a given time, depending on the time required for fresh supply of condensate to collect in the liquid seal in a quantity sufficient to close the above-mentioned connection.

When a connecting conduit of the type above described is used in the known manner to defrost an evaporator part, the device is generally adapted normally to cause defrosting to occur about once every 24 hours, and to last about 40 minutes. Correspondingly, the connecting conduit can be adapted to let through a desired quantity of heat to release ice from the dividing wall and the ice tray at suitable times. The time required for freezing water to ice in an ice tray can be established. On the one hand it depends on the capacity of transferring heat of the evaporator part used for the purpose. Thus, the dimensions of the sump and the siphon are such that heating of the dividing wall occurs at suitable times and during a period sufficient for the purpose. It is important, however, to see to it that heating does not occur before freezing of ice has been accomplished. It is less important if heating is delayed a small amount of time after freezing. The energy required for defrosting an evaporator part may vary from time to time, but the quantity of heat required for separation of ice from the dividing wall and tray is about the same each time.

According to the teachings of the present invention, it is possible to start the heat supply at any desired time. The sump and the siphon are not designed as in the known devices, in which the siphon starts after a given quantity of liquid has collected in the sump. Instead, these parts are made so that the liquid does not initiate emptying of the liquid seal, for example when the top of the siphon is higher than the sump. The siphon 42,43 starts operating by means of the supply of heat to the short leg 42, as shown in FIG. 3, in which the short leg is heat-conductively connected to an electric heating cartridge 44, the latter being connected to a source of energy (not shown) by way of conducting wires 45 through a thermostat 46 which by means of an impulse conduit 47 with a sensor 48 senses the temperature at the underside of the ice tray 38. However, a manually operated switch or an electric time switch can be used to achieve release of the ice at fixed times instead of the thermostat 46.

Another way of separating the ice cubes is shown in FIG. 4. In this embodiment the siphon is caused to start operating by a heat-conducting body 49, which is preferably of a wedge shape, and which is movable so that in its retracted position it has no influence on the apparatus, whereas in its normal position it forms a heat-conductive connection between the vapor conduit 31 and the short leg 42 of the siphon.

Figure 5:
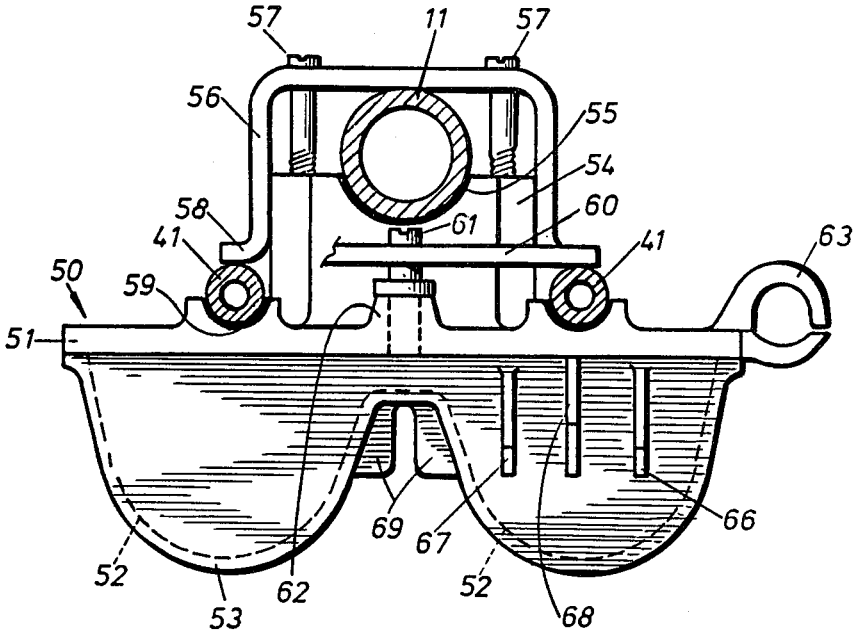
FIG. 5 is a front elevational view, partly in section, of the dividing wall and ice tray, and shows heat-conductive connections having pipes, from the refrigerating apparatus.
Figure 6:
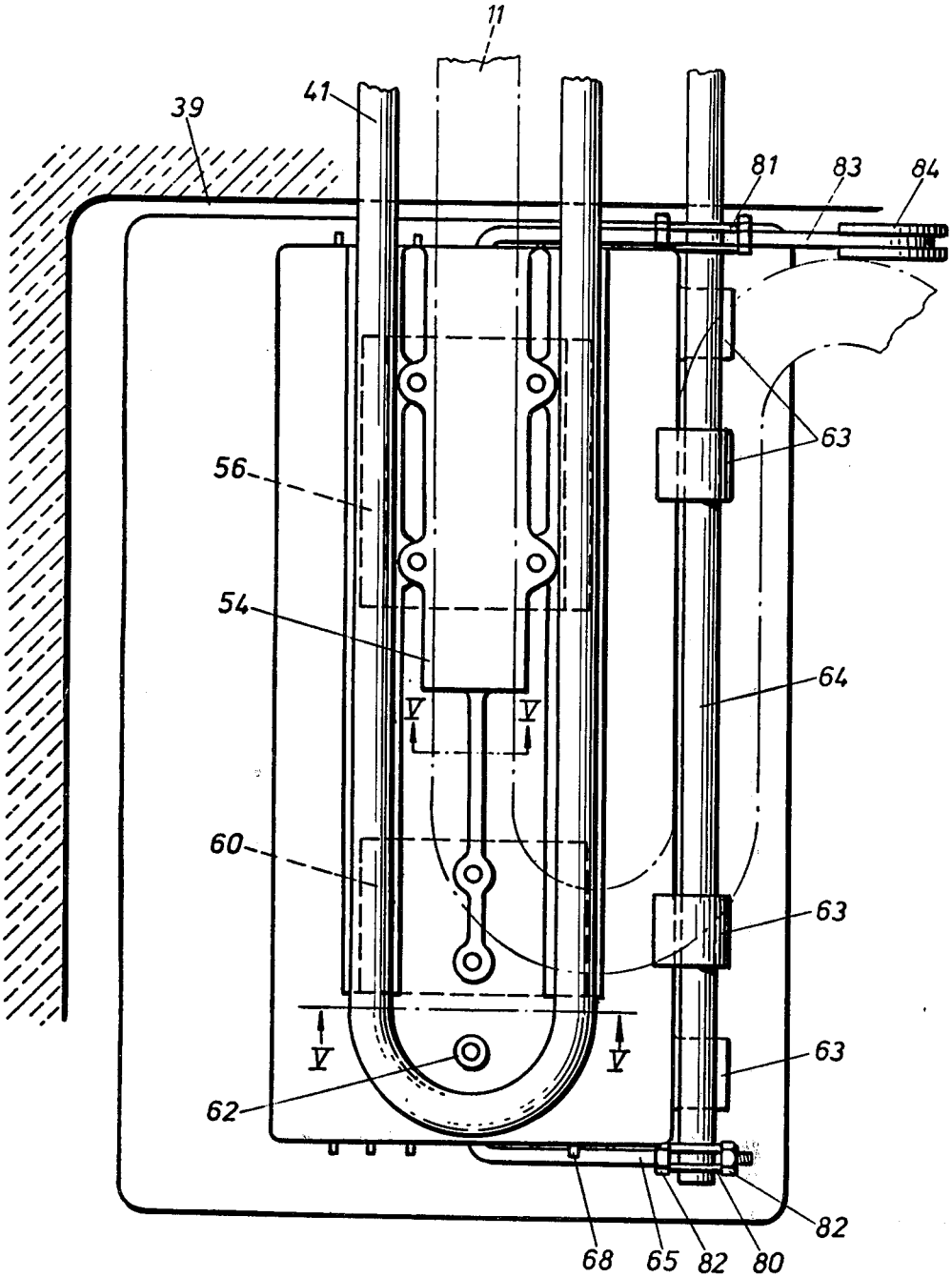
FIG. 6 is a top plan view showing the dividing wall shown in FIG. 5 placed in its location below the pipes, but without fastening plates.
Figure 8:
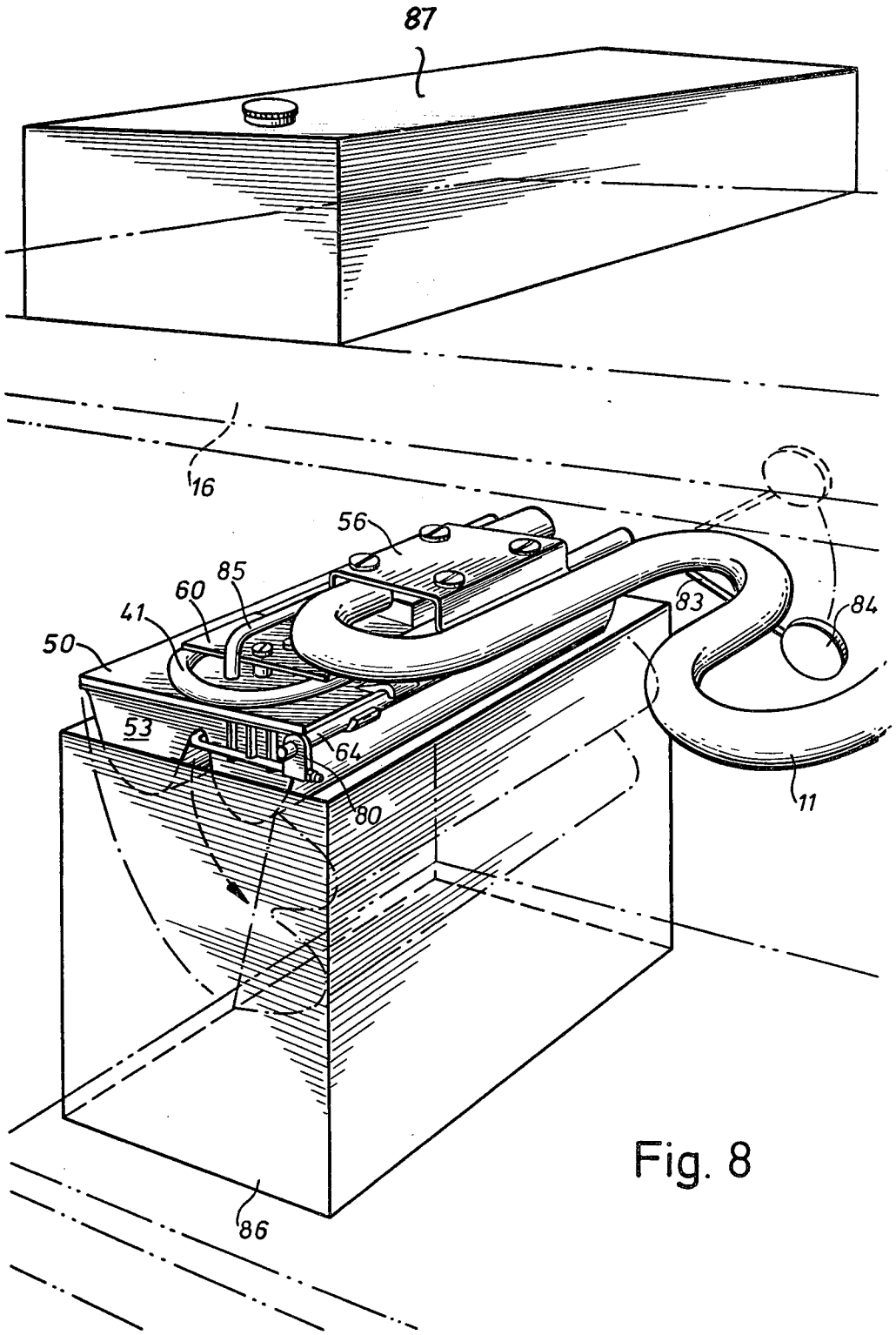
FIG. 8 is a perspective view of certain details of construction such as the ice tray having an ice dividing wall and ice collector.

It is known that absorption refrigerators have an ice tray with an ice dividing wall that is entirely separated from the refrigerator and is taken out of a freezing chamber when ice cubes are to be used. In the new device, the dividing wall 50 is instead attached in direct heat-conductive connection to a straight part of the low temperature evaporator 11, as seen in FIGS. 5 and 6. The dividing wall 50 is of heat-conducting material, for example, aluminum, and includes a plate 51 under which are two rows of fins 52 extending into an ice tray 53 fabricated of a suitable material. The dividing wall has upwards extending means for heat-conductive contact with both the evaporator part 11 and the vapor conduit 41. The dividing wall 50 has a rear part 54 which is relatively high and has a cylindrical recess 55, which corresponds to the outer form of the evaporator pipe 11. Over the wall 50 is located a yoke 56, and screws 57 by which the wall is securely mounted under the evaporator pipe 11 and is kept pressed thereto in good heating conductive contact. The pressure areas of the yoke 56 are formed by edge portions 58 bent into another plane and abutting the U-shaped vapor conduit 41. Its bottom part in FIG. 5 lies in front of the figure, and in FIG. 6 it is cut away on the line V—V. The dividing wall 50 has a U-shaped recess 59 corresponding to the form of the vapor conduit 41. In front of the dividing wall part 54, which is heat-conductively connected to the evaporator pipe 11, a metal plate 60 is placed over the vapor conduit 41, which is clamped between the dividing wall 50 and the plate 60 by means of screws 61.

As seen in FIG 6, a nipple 62 is positioned ahead of the plate 60. Thus, the dividing wall 50 has a nipple 62 with connecting means to a conduit for the supply of water to the ice tray.

As seen in FIGS. 5 and 6, the dividing wall 50 is provided with lugs 63 for a shaft 64 that supports a wire bracket 65 extending over shoulders 66,67 and under a shoulder 68 of the end piece of the ice tray 53. From there the bracket extends under the tray in a guide between wings 69 and behind the ice tray back to a pivot arrangement.

Figure 7:
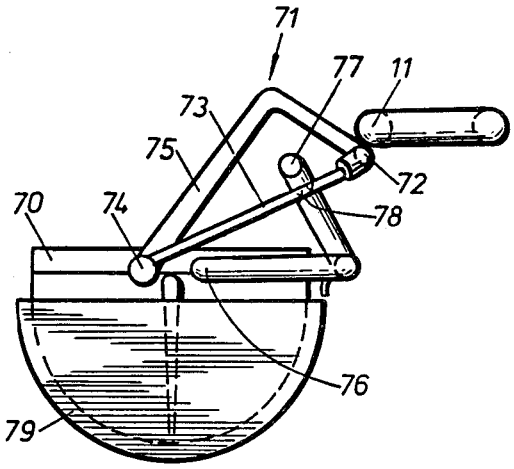
FIG. 7 is a diagrammatic view of a modification of the invention provided with a dividing wall which is connected to the evaporator of the refrigerating apparatus by way of a secondary system.

In FIG. 7 an assembly is shown diagrammatically in which the dividing wall 70 is heat-conductively connected to the evaporator 11 by way of a secondary system 71 operating with condensation and evaporation. This system includes a part 72 which is positioned parallel to, and heat-conductively connected to the evaporator 11. The refrigerant enclosed in the system in part 72 condenses and flows through a conduit 73 to an evaporation part 74, which is heat-conductively connected to the dividing wall 70. The refrigerant vapor is returned to the condensation part 72 by way of a conduit 75.

The vapor conduit extends from the boiler system of the apparatus which can be opened occasionally and has a part 76 in heat-conductive connection with the dividing wall 70. After having passed the part 76 the vapor is conducted through conduit 77 to the higher temperature evaporator near the refrigerating apparatus. The vapor conduit 77 is heat-conductively connected to the condensate conduit 73 of the secondary system 71 by a weld 78 or by another suitable means.

When the ice cubes are to be freed, vapor is let through the vapor conduit 76,77 thus heating the part 76 thereof which is heat-conductively connected to the dividing wall. When the dividing wall is heated, the ice cubes below are released from it and also from the ice tray 79, which is movably arranged under the dividing wall. As long as the vapor conduit is open, the condensate conduit 73 is affected through the heat-conductive connection 78 in such a way that no condensate reaches the evaporator part 74 in the secondary system, and thus transfer of heat from the dividing wall ceases occasionally while ice is being released.

FIGS. 6, 8, 9, and 10 clearly show the disposition of the parts providing the automatic functions of the arrangement to be set forth in detail hereinafter. As seen in FIG. 6, one end of the shaft 64 supports the ice tray 53 by means of the wire bracket 65, attached to the shaft 64 by two metal yokes 80, 81 over a threaded bracket part with nuts 82, and the other end of the shaft supports a counterweight 84 on an arm 83. The counterweight 84 is of such size that an empty ice tray 53 is moved to the correct position against the dividing wall 50 and is retained there. A latch member, which will be described hereinafter, retains the ice tray in this position while water is supplied through a conduit 85 opening into the nipple connection 62. When ice has been made in the tray, it is emptied into the collecting box 86 under the tray by means of a supply of heat to the dividing wall 50 through the conduit 41 so that the latch is released thereby dumping the ice cubes. The ice in the tray 53 is released from the dividing wall because of the heat supply and particularly from the downwardly extending fins or plates 52 thereof dividing ice into cubes (FIG. 5). In this release position, the ice tray 53, with its contents of cubes, is capable of counterbalancing the counterweight 84, and the tray pivots about the shaft 64 into the position indicated by dot-dashed lines in FIG. 8. The ice cubes slide from the ice tray and are collected in the box 86, whereafter the tray cannot counterbalance the counterweight 84 any more but returns to the ice freezing position, i.e., where it is associated with the dividing wall 50.

Figure 9:
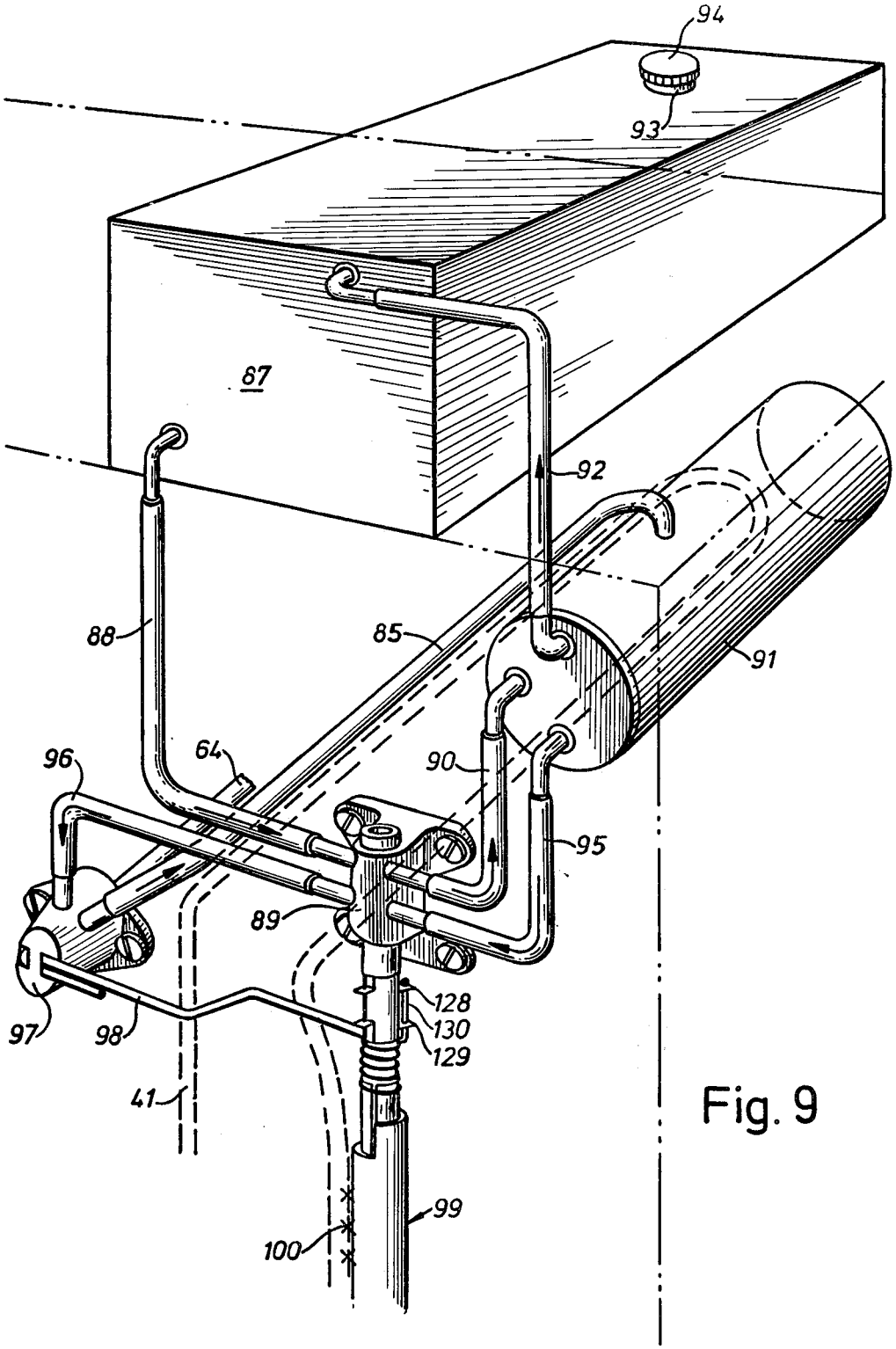
FIG. 9 is a perspective view of the water supply for the ice tray, and ice freezing control means located at the rear of the refrigerator.

FIG. 9 is a perspective outside view of an upper rear corner of the refrigerator, and only those parts are illustrated therein which are relevant to the invention, whereas the parts of the absorption refrigerating apparatus are omitted. Positioned on top of the refrigerator is a water storage vessel 87. A conduit 88 is connected to the bottom of the vessel and leads to a valve housing 89 for the conduits to and from a vessel 91 disposed in the refrigerator lining and positioned under the storage vessel 87. The volume of the vessel 91 which functions as a dosing vessel is adapted for filling an ice tray 53. A vent conduit 92 extends from the vessel 91 to the upper part of the storage vessel 87, the latter having a filler socket 93 with a cap 94. A second water conduit 95 is shown returning from the dosing vessel 91 to the valve housing 89, with a corresponding conduit 96 leading to a safety valve 97, from which extends the supply conduit 85 for supplying water to the ice tray.

The safety valve 97 is provided with a turnable tap, connected to the support shaft 64, and a passage by which the conduits 96 and 85 communicate only in that position of the shaft 64 which corresponds to the freezing position of the ice tray 53. The tap of the safety valve 97 has a front part which by a movable latch arm 98 can be locked in that position of the shaft 64 which corresponds to the freezing position of the ice tray as seen in FIG. 9. The function of the latch arm 98 will be described hereinafter.

The valve housing 89 is also provided with a turnable tap having two separated passages arranged in one position of the tap to connect the conduit 88 from the storage vessel 87 and the conduit 90 leading to the dosing vessel 91, and in another position to connect the conduit 95 exiting from the dosing vessel 91 and the conduit 96 leading to the safety valve 97.

In connection with the previous description of FIGS. 3 and 4, it has been shown that it is possible, when desired, by special measures to provide a supply of heat to the dividing wall 37 by means of the vapor conduit 41. This conduit is indicated by dotted lines in FIG. 9, in which is seen a U-shaped part of the conduit 41 abutting the dividing wall. Another part of the conduit 41 is heat-conductively connected to a guide 99. In the example shown, the guide is fixed to the conduit 41 by a weld 100. However, instead it can be attached to the wall of the refrigerator, and heat-conductively connected to the conduit 41 in another way.

Figure 10:
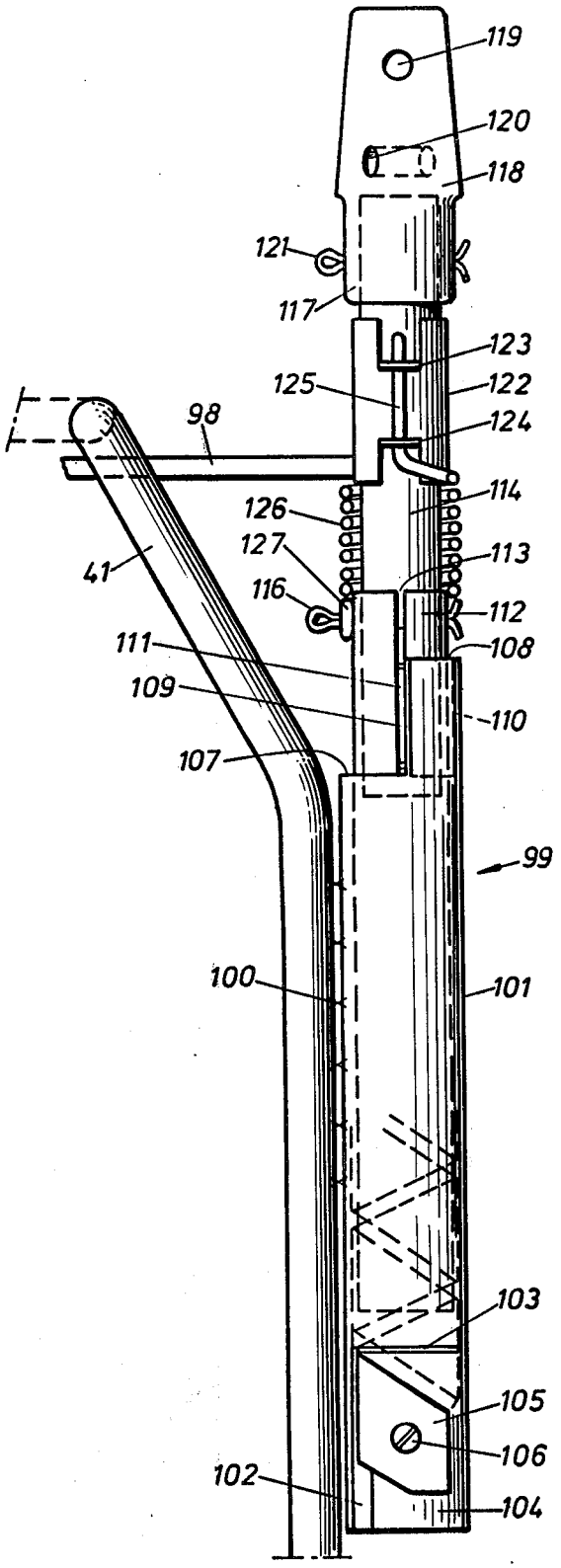
FIG. 10 is a view of part of the control means on an enlarged scale.

The guide 99 and the parts included therein, which are shown on an enlarged scale in FIG. 10, has an exterior guide sleeve 101 in its lower part, which is the part of the guide that is secured to and heat-conductively connected to the vapor conduit 41 by the weld 100. At its lower end, the guide sleeve 101 has an L-shaped cut with an axial portion 102 and a peripheral portion 103 on the conduit. The end portion 105 of a coiled bimetallic strip disposed in the guide sleeve 101 is inserted through the slot formed axially along the cut. Moreover, the end portion 105 is attached to the flap 104 by means of a screw 106. The upper part of the sleeve 101 is cut on two levels, and the two edges 107, 108 of the guide 101 on these levels are connected to each other by axial edges 109, 110 respectively. The upper free end 111 of the bimetallic strip projects above the edge 107 of the sleeve 101 where it is flattened and bent inwardly with a diametric portion whose end extends over the edge 107. As seen in FIG. 10, the end of the strip is directed away from the viewer, which is the position assumed by the strip when the guide is in its cold condition. When heated by vapor conducted through the vapor conduit 41, the strip tends to turn clockwise as seen from above and reaches the stop formed by the edge 110 of the guide sleeve 101. By choosing a suitable form, length, and material of the bimetallic strip, a comparatively great turning of the upper end of the strip can be achieved. Furthermore, one can determine the angle in which the strip shall move between the cold and the warm position by means of the stop 110. In the example shown, the strip turns through about 60 degrees.

A follower sleeve 112 is located within the coiled bimetallic strip, which to a certain extent guides the movement of the strip but also has an upper slot 113 through which the upper end 111 of the strip projects, so that the sleeve 112 turns with the strip. In the follower sleeve is a tubular tap shaft 114 with a lower slot 115 over the end 111 of the bimetallic strip. The sleeve 112 and the tap shaft 114 are joined by a split pin 116 so that the shaft turns with the sleeve. As seen, the shaft extends into a tubular part 117 of a valve tap 118 having an upper and a lower passage 119, 120 at different angles so as to coincide with the conduit connections through the valve 89 of FIG. 9. The tap shaft 114 is fastened to the tubular part 117 of the tap by a split pin 121.

A freely movable sleeve 122 is positioned around the tap shaft 114. Two lugs 123, 124 are cut and bent out from the sleeve, which lugs have holes for an axial end part 125 of a coiled spring 126, whose other end is in the form of a loop 127 around the split pin 116, which follows the turning of the bimetallic strip. At its back the sleeve 122 is provided with lugs 128, 129 corresponding to the lugs 123, 124 for an angular portion 130 of the latch arm 98, the entire assembly of which is shown in FIG. 9.

The arrangement in accordance with the present invention operates as follows:

The refrigerating apparatus is started and the storage vessel 87 is filled with water. The shaft 64 is maintained in position by the latch arm 98 and the safety valve 97 is open. The tap of the valve 89 is in a position in which there is no communication between the storage vessel 87 and the dosing vessel 91, whereas the connection between the vessel and the safety valve 97 is open. No water comes to the ice tray since no water has yet reached the dosing vessel 91.

The refrigerating apparatus operates and cools the refrigerator chambers. Now, one can either wait until the vapor conduit 41 is automatically heated or in exceptional circumstances, the means supplying heat to the short leg of the siphon can be acted upon manually so that the vapor conduit 41 starts functioning without delay. Then, the guide 99 becomes active, and the turning of the bimetallic strip causes the latch arm 98 to be drawn out of its locking position in a safety valve. The shaft 64 comes free, but the tray stays in the freezing position because it is empty and not capable of counterbalancing the counterweight. However, the valve 89 is shifted so that the upper passage 119 makes communication between the storage vessel 87 and the dosing vessel 91, and the connection between this vessel and the safety valve is closed.

After a period of heating, the vapor conduit 41 cools and the parts of the guide 99 turn to the cold position, so that the latch arm 98 is moved into the locking position and the valve 89 is shifted so that the upper passage 119 is blocked and the lower passage 120 leads water from the dosing vessel 91 to the safety valve 97, which is open, and water is supplied through the conduit 85 to the ice tray.

Then there is a period of ice freezing automatically followed by heating of the vapor conduit 41. The parts of the guide 99 are turned, the latch arm 98 is moved out of its locking position and the heat affects the dividing wall so that the ice cubes come free thereof, whereupon the ice tray turns downwards and the cubes slide out of the ice tray. The empty tray is balanced by the counterweight and returns to the freezing position. Meanwhile, the valve 89 has shifted so that the upper passage 119 is open and the vessel 91 is filled with water, while the passage 120 from the dosing vessel is closed.

When the vapor conduit cools, the latch arm 98 returns to the locking position and the valve 89 is shifted again so that the passage from the dosing vessel 91 to the safety valve 97 and through the conduit 85 to the ice tray is open.

It should be evident that ice making and release of ice cubes, as described above, continues until so much ice has collected in the collecting vessel 86 that the ice tray cannot turn downwards sufficiently to be emptied. It will then stay in a position in which the safety valve is closed so that no more water can reach the ice tray.

The latch arm 98 cannot be returned into locking position, i.e. in the position in which water can be supplied by the safety valve. Therefore, the coiled spring 126 is arranged in the guide 99, and thus it is possible for the guide to turn the tap 118 between its two angle positions, whereas the sleeve 122 can remain in the cold position even if the guide 99 is heated. The resulting turning of the bimetallic strip is transferred to the tap 118 but not to the sleeve 122, and instead the turning of the follower sleeve 112 is absorbed by the spring 126.

It should be apparent that the above-described valves and control means can be modified in many ways without going beyond the scope and spirit of the invention. For example, the valve 89 can be a three-way valve, in which case the conduits 90 and 95 between the valve and the dosing vessel 91 are replaced by a single conduit.

What is claimed is:

1. An assembly and control system for manufacturing and separating ice cubes performed by an absorption refrigeration apparatus having a freezing means provided with a water supplied ice making device having an ice tray comprising: means for transferring energy from said ice making device to said absorption refrigeration apparatus for freezing ice in said ice tray, means for transferring energy from said refrigerating apparatus to said ice making device for releasing the ice in said ice tray, a control device for said ice making device, and means for controlling said control device and its water supply by energy transfer by operating media of said refrigerating apparatus.

2. The arrangement as claimed in claim 1 further comprising an ice cube divider constituted of heat conducting material and having a freezing plate and being associated with said ice tray, said means for transferring energy from the refrigeration apparatus to said freezing plate of the ice making device is a heat transfer means that is adapted to heat said freezing plate, said ice tray being disposed under said freezing plate and ice cube divider and movable from a freezing position to an emptying position and vice versa, means for returning said ice tray to the freezing position, an arrangement for supplying heat occasionally to said freezing plate, and means for automatically supplying water to said ice tray.

3. The arrangement as claimed in claim 2 wherein said ice tray is supported under said freezing plate whereby said tray is turnable to an emptying position in which the ice therein will fall out.

4. The arrangement as claimed in claim 2 further comprising a shaft extending in a plane generally parallel to an edge of said ice tray, said ice tray being capable of being pivoted about said shaft.

5. The arrangement as claimed in claim 4 further comprising an arm having a counterweight of sufficient size such that it is capable of moving the ice tray to a rest position against said freezing plate in a freezing position, but is not capable of retaining a full ice tray in said freezing position.

6. The arrangement as claimed in claim 5 further comprising a releasable locking means for retaining said ice tray against said freezing plate while water is being supplied to the ice tray, and said water is frozen therein.

7. The arrangement as claimed in claim 6 further comprising a temperature sensor acted upon by means of said heat supply to said ice making device for control of ice releasing means and water supply means.

8. The arrangement as claimed in claim 7 wherein said temperature sensor is a bimetallic element.

9. An assembly and control system for manufacturing and separating ice cubes performed by an absorption refrigeration apparatus having a freezing means provided with a water supplied ice making device having an ice tray comprising means for transferring energy from said refrigeration apparatus to said ice making device for freezing ice in said ice tray, means for transferring energy from said ice making device to said absorption refrigeration apparatus for releasing the ice in said ice tray, a control device for said ice making device, means for controlling said control device and its water supply by energy drawn off said refrigerating apparatus, a water storage vessel, a water dosing vessel, conduits having a valve and connecting said storage vessel to said dosing vessel, pipe means having a valve and connecting said dosing vessel to said ice tray, said water storage vessel supplying water to said dosing vessel when the valve in said conduits is open, and said dosing vessel supplying water to said ice tray when the valve in said pipe means is open, said valves being arranged so that when one is open the other is closed and vice versa, and temperature controlled means controlling both of said valves and being in contact with said means for transferring energy from said refrigerating apparatus to said ice making device.

10. An arrangement as claimed in claim 9 further comprising a shaft extending in a plane generally parallel to an edge of said ice tray, a safety valve, a movable part of said safety valve being connected to said shaft in such a manner that the valve is open in the freezing position of said ice tray but closed when said ice tray is in another position.

11. The arrangement as claimed in claim 10 further comprising a movable latching means, and the movable member of said safety valve being arranged to co-act with said movable latching means that can be brought into latched condition when said ice tray is in the freezing position.

12. The arrangement as claimed in claim 9 further comprising a temperature sensor, said means for transferring energy from said refrigerating apparatus to said ice making device being a vapor conduit heat transfer means, said valve in said conduits and the valve in said pipe means are connected to said sensor that is heated by said vapor conduit in such a manner that when the vapor conduit is cold said valve in said conduits is closed the valve in said pipe means is open, and when said vapor conduit is heated said valve in said conduits is open and said valve in said pipe means is closed.

13. The arrangement as claimed in claim 12 wherein the same sensor controls said two valves and said moveable latching means.

14. The arrangement as claimed in claim 13 wherein said sensor is a bimetallic part having a coiled leaf spring in which one end is fixed and the other end is movable upon change of temperature.

15. The arrangement as claimed in claim 14 further comprising a spring, said movable latching means being connected to said movable end of the bimetallic part through said spring, the latter being connected to said movable end of the bimetallic part through said spring, the latter being capable of absorbing the turning movement of said bimetallic part if the valve in said pipe means which co-acts with said latching means is not in the latched position.

16. The arrangement as claimed in claim 15 wherein said latching means is a movable latch arm.

17. The arrangement as claimed in claim 16 further comprising a rotatable shaft, said bimetallic part being connected to said valves by said rotatable shaft, and further comprising a rotatable sleeve arranged on said rotatable shaft and linked to said latch arm and to said bimetallic part by means of said spring.

* * * * *